US008759273B2

(12) United States Patent
Zordan et al.

(10) Patent No.: US 8,759,273 B2
(45) Date of Patent: Jun. 24, 2014

(54) THICKENING COMPOSITION COMPRISING A COPOLYMER OF POLYDIALLYLDIMETHYLAMMONIUM CHLORIDE AND ACRYLAMIDE

(75) Inventors: Giovanni Zordan, Ludwigshafen (DE); Antonella Torchiaro, Mira (IT)

(73) Assignee: Reckitt Benckiser N.V., WT Hoofddorp (NL)

( * ) Notice: Subject to any disclaimer, the term of this patent is extended or adjusted under 35 U.S.C. 154(b) by 0 days.

(21) Appl. No.: 13/577,009

(22) PCT Filed: Feb. 9, 2011

(86) PCT No.: PCT/GB2011/050229

§ 371 (c)(1), (2), (4) Date: Oct. 4, 2012

(87) PCT Pub. No.: WO2011/098802

PCT Pub. Date: Aug. 18, 2011

(65) Prior Publication Data

US 2013/0029898 A1 Jan. 31, 2013

(30) Foreign Application Priority Data

Feb. 12, 2010 (GB) ..... 1002356.2

(51) Int. Cl.
*C11D 3/37* (2006.01)

(52) U.S. Cl.
USPC ..... 510/331; 510/276; 510/318; 510/361; 510/398; 510/434; 510/477; 510/504

(58) Field of Classification Search
USPC ..... 510/276, 318, 331, 361, 398, 434, 477, 510/504
See application file for complete search history.

(56) References Cited

U.S. PATENT DOCUMENTS

| | | | | |
|---|---|---|---|---|
| 5,344,643 | A * | 9/1994 | Thiel et al. | 424/70.11 |
| 6,172,019 | B1 * | 1/2001 | Dehan et al. | 510/153 |
| 2002/0058059 | A1 * | 5/2002 | Embrechts et al. | 424/450 |
| 2002/0132886 | A1 | 9/2002 | Meffert et al. | |
| 2003/0086820 | A1 * | 5/2003 | McDonnell et al. | 422/28 |
| 2003/0104018 | A1 * | 6/2003 | Bettle et al. | 424/401 |
| 2003/0198654 | A1 * | 10/2003 | Palazzolo | 424/401 |
| 2005/0124690 | A1 * | 6/2005 | Yoon et al. | 514/462 |
| 2005/0180939 | A1 | 8/2005 | Fonolla Moreno | |
| 2006/0094610 | A1 * | 5/2006 | Yamato et al. | 510/130 |
| 2007/0074355 | A1 * | 4/2007 | Lee | 8/405 |
| 2007/0259794 | A1 * | 11/2007 | Wachsberg | 510/119 |
| 2008/0008672 | A1 * | 1/2008 | Tobita | 424/70.1 |
| 2008/0194662 | A1 * | 8/2008 | Kunin | 514/385 |
| 2008/0196787 | A1 * | 8/2008 | Comstock et al. | 141/9 |
| 2008/0227677 | A1 * | 9/2008 | Grascha et al. | 510/139 |
| 2009/0029898 | A1 * | 1/2009 | Voelkel et al. | 510/353 |
| 2009/0169644 | A1 * | 7/2009 | Goddinger et al. | 424/642 |
| 2010/0034893 | A1 * | 2/2010 | Pfluecker et al. | 424/490 |
| 2010/0035782 | A1 * | 2/2010 | Decoster et al. | 510/122 |
| 2010/0297047 | A1 * | 11/2010 | Santus et al. | 424/60 |
| 2012/0022165 | A1 * | 1/2012 | Bettle et al. | 514/627 |

FOREIGN PATENT DOCUMENTS

| | | | |
|---|---|---|---|
| EP | 1647591 | A1 | 4/2006 |
| GB | 2193501 | A | 2/1988 |
| JP | 2007308579 | A | 11/2007 |
| WO | 2005073358 | A1 | 8/2005 |

OTHER PUBLICATIONS

International Search Report for application PCT/GB2011/050229 dated May 23, 2011.

Written Opinion of the International Searching Authority for application PCT/GB2011/050229 dated May 23, 2011.

GB Search Report for application GB1002356.2 dated Jul. 30, 2010.

English language abstract for JP 2007-308579 which published Nov. 29, 2007.

* cited by examiner

*Primary Examiner* — Charles Boyer

(74) *Attorney, Agent, or Firm* — Norris McLaughlin & Marcus PA

(57) ABSTRACT

A liquid detergent composition has a thickening system which comprises;

(a) a carboxylic acid/carboxylate polymer, and (b) a polymer comprising an ammonium group.

8 Claims, No Drawings

THICKENING COMPOSITION COMPRISING A COPOLYMER OF POLYDIALLYLDIMETHYLAMMONIUM CHLORIDE AND ACRYLAMIDE

This is an application filed under 35 USC 371 of PCT/GB2011/050229.

This invention relates to aqueous liquid detergents, preferably for use as a laundry composition or in conjunction with a laundry detergent.

Liquid based laundry compositions have been known for many years. A major issue encountered with such compositions has been the achievement of a suitable viscosity for the liquid: the liquid has to be viscous enough so that any particles are suspended yet have a sufficiently high degree of flow for ease of manufacture and dispense by a consumer.

To achieve the desired rheology typically thickeners are used. These thickeners are rheology modifiers suitable for liquid detergents. They are used to associate a higher concentration of active ingredients and to aggregate them in a stable matrix.

Numerous thickening systems have been developed over the years but there is still room for improvement in such systems, particularly as regards cost effectiveness and environmental concerns.

Different kinds of thickener are commercially available. One class of thickener that is used extensively are those based upon polymeric-carboxylic acids and their salts.

Whilst generally these thickeners are highly effective one significant disadvantage in their use is that their efficacy is highly dependent on the pH and ionic strength of the liquid in which they are employed. Indeed the thickening effect of carboxylic acid based thickeners is only significant in alkaline solutions and/or solution having low ionic strength when the carboxylic acid based thickeners are in a dissociate state.

In such a condition the thickening mechanism is based on 2 main effects:

In an alkaline environment the carboxylic acid dissociates to carboxylate anions. As a result the electrostatic repulsion of the anions causes the stretching of the polymer chain. This phenomenon reduces the degrees of freedom of the structure in the liquid matrix.

Moreover the carboxylate anions interact with the hydrophilic heads of the surfactant micelles, creating a tri-dimensional network between the thickener backbone and the micelles (associative effect).

The result of these two effects in the right conditions is the increase of viscosity of the liquid.

It is therefore a primary object of this invention to develop stabilised laundry detergent composition which incorporates a low cost, but effective, thickening system over a broad range of conditions.

According to the first aspect of the present invention there is provided a liquid detergent composition having a thickening system which comprises;

(a) a carboxylic acid/carboxylate polymer, and (b) a polymer comprising an ammonium group.

With the thickening system of the present invention it has been found that superior thickening of a liquid detergent composition can be achieved. Indeed it has been observed that the level of thickening is over and above what would be expected by the use of the two thickeners individually. Thus without wishing to be bound by theory it is postulated that there is a positive, synergistic interaction between the two thickening species which gives and added level of thickening. Without wishing to be limited by theory it is postulated that the synergistic thickening effect depends on the interaction between ammonium groups of polymer (b) and the carboxylate groups of polymer (a).

Preferably the polymer species (a) is an associative thickener. Most preferably the thickener is of the HASE-type: hydrophobic modified alkaline soluble emulsion.

A preferred example of polymer species (a) is a polyacrylate available from BASF under the Trade Name Sokolan AT120.

Preferably the polymer containing an ammonium species is a polyamide or a copolymer of a polyamide. A preferred example of such a polymer is Polyquaternium 7 a copolymer of DADMAC (Diallyl-Dimethyl-Ammonium chloride) and Acrylamide.

Enzymes

The enzymes suitable for use in the compositions include protease and amylase enzymes.

The proteolytic enzymes suitable for the present compositions include the various commercial liquid enzyme preparations which have been adapted for use in association with detergent compositions. Enzyme preparations in powdered form are also useful although, as a general rule, less convenient for incorporation into liquid compositions. Suitable liquid enzyme preparations include "Alcalase", "Savinase", and "Esperase", all trademarked products sold by Novo Industries, Copenhagen, Denmark, and "Maxatase", "Maxacal", and "AZ-Protease" and "Properase" sold by Gist-Brocades, Delft, The Netherlands.

Among the suitable alpha-amylase liquid enzyme preparations are those sold by Novo Industries and Gist-Brocades under the tradenames "Termamyl" and "Maxamyl", respectively.

Mixtures of proteolytic and amylase enzymes can and often are used to assist in removal of different types of stains.

The proteolytic enzyme and/or amylase enzyme will normally be present in the compositions in an effective amount in the range of from about 0.05% to about 5%, preferably from about 0.5% to about 2%, by weight of the composition. Generally, lower levels of amylase are required.

Additional Enzyme Stabilisers

Preferably a salt of the hydroxycarboxylic acid such as sodium citrate which is preferred because of its ready availability and contribution to improving physical to improving the physical stability of the composition—i.e. preventing phase separation, as well as providing efficacy against oxidizable stains, e.g. coffee and wine stains. However, other hydroxydi- or hydroxytri-carboxylic acids can be employed, such as malic acid, tartaric acid, isocitric acid or tri-hydroxyglutaric acid. The preferred sodium citrate is conveniently used in the form of its dihydrate. Alternatively, citric acid itself may be used in formulating the compositions. However, since the compositions are at an alkaline pH, the hydroxydi- or hydroxytri-carboxylic acid will be present in its ionized salt state. This ingredient is used in an amount ranging of about 5% to about 20% of the entire enzyme-containing composition, preferably amounts of from 8% to 15%, and more preferably in amounts of from 10% to 13%.

An alkali metal chloride, preferably sodium chloride. This ingredient is used in an amount of from about 2% to about 15% based on the weight of the entire enzyme-containing composition; preferably, the chloride ingredient is used in amounts ranging from 4% to 12%, and more preferably from 5% to 8%.

Surfactant

The preferred enzyme-containing compositions also contain from about 0.05% to about 5% of a $C_8$-$C_{18}$ alcohol alkoxylated with 3 to 6 moles of ethylene oxide. A wide variety of alkoxylated fatty alcohols are known to the art and these vary considerably in HLB (hydrophile-lipophile balance). For purposes of this invention, it is preferable to employ an alkoxylated alcohol which is relatively hydrophobic. Preferred surfactants are fatty alcohols having from about about 15 carbon atoms, alkoxylated with about 4 to 6 moles of ethylene oxide. A particularly preferred surfactant is that sold under the trademark Lialet 125 and has a formulation of $C_{12}$-$C_{15}$ alcohols alkoxylated with 5 moles of ethylene oxide. These nonionic surfactants are preferably present in the enzyme-containing compositions of this invention in amounts ranging from 0.1% to 2%, more preferably from 0.3% to 1%.

Additional

To bring the pH to within the desired range of a sufficient amount of an acid or an akali is added to adjust the pH.

The compositions of this invention desirably also contain at least one organic solvent which is preferably water-miscible. Such useful organic solvents include: the linear alcohols such as ethanol, isopropanol and the isomers of butanol; diols; glycols such as ethylene glycol, propylene glycol and hexylene glycol; glycol ethers, etc. Low molecular weight solvents, i.e. those from 1 to 8 carbon atoms, are preferred. A particularly preferred solvent is propylene glycol.

The composition additionally comprises up to 10% wt, 8% wt, 6% wt, 4% wt, 2% wt, 1% wt or 0.5% wt of minor ingredients selected from one or more of the following: dye, fragrance, preservative, optical brightener, dye transfer inhibitor or a bittering agent.

Further thickeners may be added. These include polymeric substances which function as viscosity stabilizers and aid in enzyme stabilization. Exemplary of such polymeric compositions are polyacrylic acid, polymethacrylic acid, acrylic/methacrylic acid copolymers, hydrolyzed polyacrylamide, hydrolyzed polymethacrylamide, hydrolyzed polyacrylonitrile, hydrolyzed polymethacrylonitrile, etc. Water soluble salts or partial salts of these polymers, as well as their respective alkali metal or ammonium salts can also be used. A preferred polymeric substance is sold under the trademark Polygel DA, which is a polyacrylic acid having a molecular weight greater than 1,000,000. These polymers are used in amounts ranging from about 0.1% to 1%, preferably about 0.4%.

A preferred thickening agent is xanthan gum which may be present in an amount of from between 0.1% and 0.5%, preferably about 0.3%. In addition to providing beneficial viscosity characteristics to the compositions, xanthan gum also assists in the removal of certain stains.

The stabilized enzyme-containing compositions of this invention can also include the usual additives usually present in compositions of this type provided, of course, that they do not detract from enzyme stability. Such additives include perfumes, dyes, preservatives, antibacterial agents, fluorescent whitening agents, pigments, etc.

Suitable preservatives include the isothiazolinones sold under the trademark Kathon DP3 and available from Rohm & Haas.

The enzyme-containing compositions may also comprise suspended particles which differ in colour or shade from the aqueous liquid composition. These particles (speckles) can serve an aesthetic purpose and can also provide an additional amount of enzyme stabilizer to the composition. Speckles can be present in amounts ranging from about 0.01 to about 1.0 weight percent. Typically, they will consist of a solid material which can function as an additional stabilizing agent, a coating which melts at a suitable temperature, and a small amount of dye.

The amount of water present in the composition is at least 50% wt, 60% wt, 70% wt or 80% wt.

The invention will be illustrated with reference to the following non-limiting Examples.

EXAMPLES

A base formulation was prepared having the following composition.

| Component | Wt % |
|---|---|
| LAS | 10-20 |
| Coconut fatty acids | 3-5 |
| Alkyletheresulphate 3EO | 3-5 |
| Fatty alcohols 7EO | 3-5 |
| TEA | 1-3 |
| DEA | 1-3 |
| Preservative | 0-1 |
| Polyquarternium 7 | 0-2 |
| Silicone Emulsion | 0-2 |
| Water | 60-80 |

To this base formulation were added thickeners as below.

| Formulation | Amount of thickener (wt %)* |
|---|---|
| A | 0 |
| B | 1 |
| C | 2 |

*The thickener used was a polyacrylate available from BASF under the Trade Name Sokolan AT120.

The viscosity of each solution was measured with a Brookfield Viscosimeter LVDV sp63 12 rpm at 20° C. The viscosity measurements are below.

| Formulation | Viscosity (cps) |
|---|---|
| A | 1880 |
| B | 4100 |
| C | 8600 |

The same measurements were taken with the addition of 0.135% of Polyquaternium 7 available from Nalco under the trade name of Merquat 550PR. The viscosity measurements and the changes in viscosity are shown in the table below.

| Formulation | Viscosity (cps) | Change (cps) | Synergy (cps) |
|---|---|---|---|
| A | 2200 | 320 | — |
| B | 4900 | 800 | 480 |
| C | 9800 | 1200 | 880 |

It can be seen that with the addition of the Polyquaternium 7 the viscosity increase in solution is much higher than would be expected and involves a synergistic additional effect.

The invention claimed is:

1. A liquid laundry detergent composition having a thickening system comprising;

(a) 0.3 to 3 wt. %, based on the total weight of said composition, of a carboxylic acid/carboxylate polymer, and (b) 0.1 to 2 wt. %, based on the total weight of said composition, of a copolymer of polydimethyldiallylammoniumchloride and acrylamide.

2. A laundry washing operation which comprises the step of:

utilizing a liquid laundry detergent composition according to claim 1 in the laundry washing operation.

3. A composition according to claim 1, wherein the (a) a carboxylic acid/carboxylate polymer is an associate thickener.

4. A composition according to claim 1, wherein the (a) carboxylic acid/carboxylate polymer is a hydrophobic modified alkaline soluble emulsion.

5. A composition according to claim 1, wherein the composition further comprises at least one enzyme.

6. A composition according to claim 1, wherein the composition further comprises at least one surfactant.

7. A composition according to claim 1, wherein the composition further comprises at least one organic solvent.

8. A composition according to claim 1, wherein the composition further comprises at least one further thickener.

* * * * *